United States Patent [19]

Schleusner

[11] 4,390,228

[45] Jun. 28, 1983

[54] VEHICLE/TRAILER LIGHTING CONNECTOR APPARATUS

[75] Inventor: Clifford E. Schleusner, Billings, Mont.

[73] Assignee: Bruce Haagenson, Billings, Mont.

[21] Appl. No.: 267,684

[22] Filed: May 28, 1981

[51] Int. Cl.[3] ..... H01R 33/76

[52] U.S. Cl. ..... 339/113 R; 339/154 A; 339/10

[58] Field of Search ..... 280/402, 408; 307/9, 307/10 LS; 191/11; 339/10, 31 R, 18 R, 18 P, 18 B, 18 C, 154 R, 154 A, 113 R, 113 B

[56] References Cited

U.S. PATENT DOCUMENTS

| | | | |
|---|---|---|---|
| 2,660,679 | 11/1953 | Hunt | 339/10 |
| 3,137,448 | 6/1964 | Holzhause | 339/154 A |
| 4,015,887 | 5/1977 | Ross et al. | 339/10 |

FOREIGN PATENT DOCUMENTS

| | | | |
|---|---|---|---|
| 944925 | 11/1948 | France | 339/154 A |

*Primary Examiner*—Eugene F. Desmond

*Assistant Examiner*—David Pirlot

*Attorney, Agent, or Firm*—Arthur L. Urban

[57] ABSTRACT

Vehicle/trailer lighting connector apparatus including a first connector portion and a second connector portion engageable with the first connector portion, the first and second connector portions each including a base section, at least three connector members associated with a major face of each of the base sections, three of the connector members of each base section being arranged in an equilateral triangular configuration, three of the connector members of one connector portion being disposed in a triangular configuration corresponding to the arrangement of the connector members of the other connector portion, each of the connector members of the first connector portion being engageable with one of the secondary connector members of the second connector portion, the second connector portion including a section separable from the second base section, the separable section including two spaced connector members reversibly engageable with two of the connector members of the second connector portion.

10 Claims, 4 Drawing Figures

VEHICLE/TRAILER LIGHTING CONNECTOR APPARATUS

This invention relates to a novel connector apparatus and more particularly relates to a new apparatus for connecting lighting circuitry of a vehicle with lighting circuitry of a trailer.

It has been common for many years to use a variety of different trailers to haul loads that cannot be handled conveniently in other ways. Originally, these trailers were home-built structures which were designed to meet the specific requirements of their owners. As a result, there was no standardization of components and each builder incorporated those features which he needed.

These trailers generally were used within a limited local area and for short periods of time. If it was necessary to use a trailer at night, the owner would travel back roads or would arrange some makeshift lighting on the rear so that overtaking traffic would not collide with the trailer. The lighting might be a kerosene lantern or an electrical lamp with temporary wiring connected to the vehicle lighting system.

As the use of trailers became more popular, businesses were established to manufacture trailers. To stimulate sales of their trailers, manufacturers offered special features that would appeal to their prospective customers. One of the features that became very popular was the inclusion of rear lights on the trailer with wiring which could be connected to the lighting system of the towing vehicle. The wiring circuitry of the trailer was connected to the lighting circuitry of the vehicle with a suitable connection such as a plug and socket to provide a convenient means for separating the two circuits when the trailer was disconnected from the vehicle.

With the increased use of trailers, laws were enacted requiring lights on all trailers. Although the original trailer lighting involved only marker or tail lights, there was a demand for brake stop lights and turn signal lights in addition to tail lights to match the lighting of the towing vehicle. This increase in the number of different trailer lights not only complicates the wiring circuitry of a trailer, but also makes it much more difficult to properly connect the trailer wiring with the lighting circuitry of the vehicle which is used for the towing.

When connecting the lighting system of a vehicle having tail lights, stop lights and turn signals with that of a trailer, it is necessary to use three wires. Ordinarily, three wires are run from the vehicle lighting circuitry to a first plug or similar connector and three wires from the trailer wiring to a second connector which is engageable with the first connector. To have the trailer lights operate in coordination with the vehicle lights, the three wires from each of the units must be interconnected in the correct alignment. However, there are six possible combinations of the wires and only one combination of the six will provide proper operation of the lights of the two units in the correct manner, that is, particular trailer lights being lighted when the corresponding vehicle lights are activated.

To achieve the proper combination of the wires, it is customary to connect the three lead wires of one connector to separate wires of the vehicle. Then, the three lead wires from the second connector are interconnected with separate wires of the trailer lights. Next, the second connector is plugged into the first connector. If the first connections do not result in the operation of the trailer lights in coordination with the vehicle lights, it is necessary to disconnect the three wires from the first or second connector and reconnect them to the appropriate wiring in a different arrangement. Should the second connections not produce the desired coordination of the lighting, the operation is repeated again with a third different wiring combination. The reconnection of the wires is repeated with different arrangements until the proper lighting effect is achieved. Since there are six wire combination possibilities, it may be necessary to repeat the reconnection six times to produce the desired result.

While the above procedure achieves the proper combination of one vehicle with one trailer, the situation is complicated when a single vehicle is used to tow more than one trailer or if a single trailer is towed by more than one vehicle. These situations may occur relatively frequently since there are vehicle owners who have several vehicles that they use to tow the single trailer that they own. On the other hand, some owners of only one vehicle may have several different trailers, that is, a boat trailer, a snowmobile trailer, a camping trailer and/or a cargo trailer and the like.

With such multiple vehicles and/or trailers, it is necessary to match the connectors of each unit with every other connecting unit. This can be very time-consuming and frustrating since there are six wiring possibilities with each pair of units. Even after the owner has matched all of his units, there still may be problems if he replaces one of the units. Also, compatibility of units may be a problem if a friend borrows a trailer which he intends to tow with his own vehicle.

A further problem created by the above experimental trial and error methods of interconnecting vehicle and trailer lighting systems is that it may require the baring, cutting, splicing and/or taping of the wires of the lighting circuits over and over again. This repeated interconnecting of the wires often produces poor connections even after the right combination is achieved. These poor connections may fail and short out the lighting systems at inappropriate times and circumstances. For example, the systems may short out during night driving conditions or may fail during adverse weather conditions such as rain or snowstorms.

Although a variety of different connectors are available commercially, they all require repeated splicing, cutting and/or baring of the wiring on a haphazard trial and error basis to achieve the correct combination of circuitry and the desired coordinated operation of the vehicle and trailer lighting systems. Thus, there is a serious need for a connecting apparatus that can overcome or eliminate the problems presently being encountered in the interconnection of vehicle and trailer lighting systems.

The present invention provides a novel apparatus for interconnecting the lighting circuitry of a vehicle with the lighting circuitry of a trailer. The lighting connector apparatus of the invention simplifies interconnection of the wiring of a vehicle with that of a trailer. The apparatus eliminates the present repeated resplicing of wires in order to produce the desired lighting arrangement.

The lighting connector apparatus of the present invention provides a simple and convenient means for achieving proper coordination of the lighting circuitry of a trailer with that of a towing vehicle. The apparatus enables an individual to achieve the required wiring combination quickly and easily in a single wiring operation. The connector apparatus can be utilized by persons of all ages and experience after a minimum of instruction. The connector apparatus facilitates interconnection of an assortment of vehicles with an assortment of trailers without resplicing any of the circuitry of either unit.

The lighting connector apparatus of the present invention is simple in design and can be manufactured relatively inexpensively. The apparatus can be fabricated from commercially available materials utilizing conventional connector manufacturing techniques. The lighting connector apparatus can be installed both on new trailers and vehicles as well as units presently in use. The installation can be accomplished in a few minutes by persons of limited electrical aptitude or experience.

Other benefits and advantages of the novel vehicle/-trailer lighting connector apparatus of the present invention will be apparent from the following description and the accompanying drawings in which.

Figure 1:
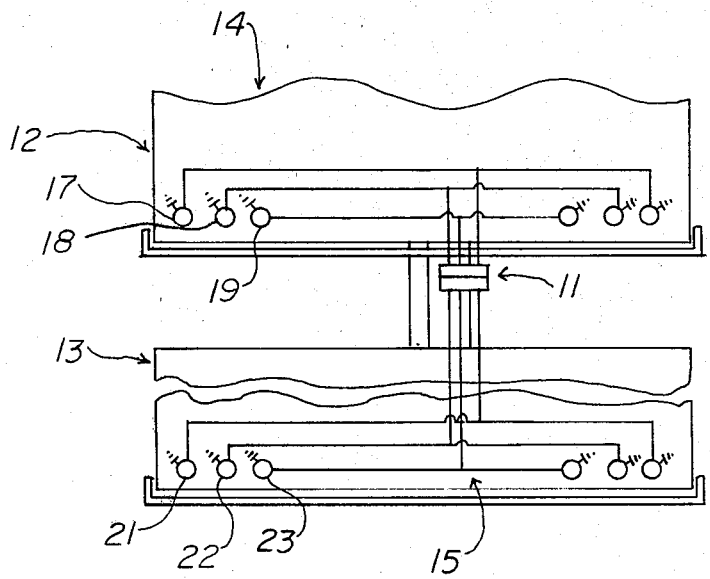
FIG. 1 is a schematic illustration of lighting circuitry of a trailer interconnected with lighting circuitry of a vehicle through one form of the lighting connector apparatus of the invention.
Figure 2:
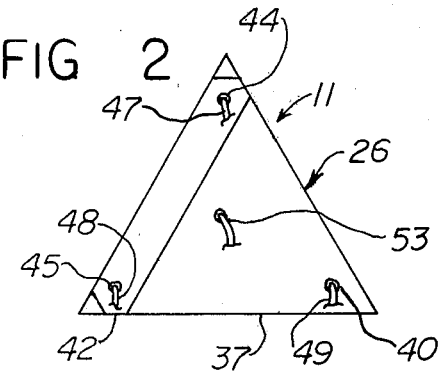
FIG. 2 is an enlarged front view of the connector apparatus shown in FIG. 1.
Figure 3:
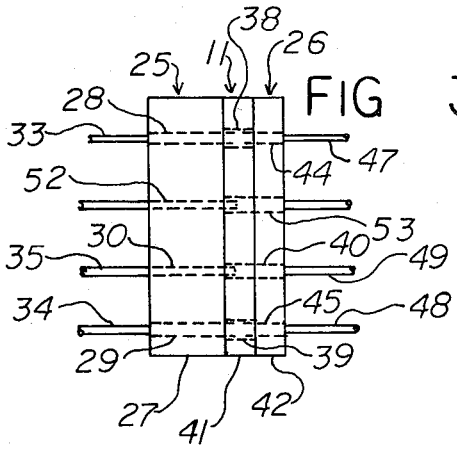
FIG. 3 is a side view of the connector apparatus shown in FIG. 2.
Figure 4:
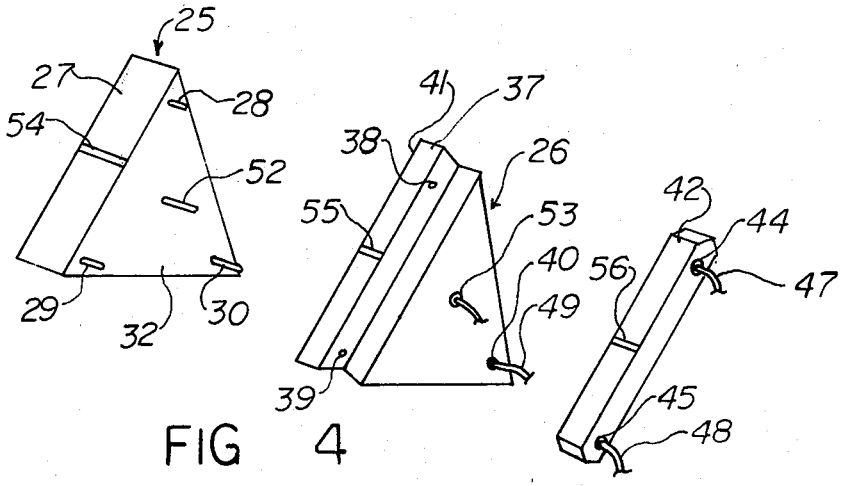
FIG. 4 is a view in perspective of the connector apparatus shown in FIGS. 2 and 3 with components separated.

As shown in the drawings, one form of the novel lighting connector apparatus 11 of the present invention is employed with a vehicle 12 and a trailer 13 attached thereto. The connector apparatus 11 interconnects the lighting circuitry 14 of the vehicle 12 with the lighting circuitry 15 of the trailer 13. The lighting circuitry 14 of the vehicle 12 includes tail lights 17, stop lights 18 and turn signals 19. Similarly, the trailer lighting circuitry 15 includes tail lights 21, stop lights 22 and turn signals 23.

The lighting connector apparatus 11 of the invention includes a first connector portion 25 and a second connector portion 26 engageable with the first connector portion. The first connector portion 25 includes a first base section 27 with at least three primary connector members 28, 29 and 30 associated therewith. The primary connector members 28–30 are disposed adjacent one major face 32 of the first base section 27. Three of the primary connector members 28–30 are arranged in an equilateral triangular configuration.

Electrical lead wires 33, 34 and 35 are affixed to the primary connector members 28–30. An end of one wire is affixed to each of the primary connector members. For example, wire 33 may have one end affixed to connector member 28 at a point thereon remote from the major face 32 of the first base section 27. Likewise, wire 34 is affixed in the same manner to connector member 29 and wire 35 to connector 30.

The second connector portion 26 includes a second base section 37 with at least three secondary connector members 38, 39 and 40. The secondary connector members are associated with a major face 41 of the second base section 37. Three of the secondary connector members are disposed in a triangular configuration with the arrangement of the secondary connector members corresponding to the arrangement of the primary connector members 28–30 of the first connector portion 25. Each of the primary connector members 28–30 of the first connector portion 25 is engageable with one of the secondary connector members 38–40 of the second connector portion 26.

The second connector portion 26 includes a further section 42 that is separable from the second base section 37. Separable section 42 includes two spaced connector members 44 and 45 that are engageable with two of the secondary connector members shown as connector members 38 and 39. The engagement of the two spaced connector members 44 and 45 with the connector members 38 and 39 is at points remote from the major face 41 of the second base section 37.

Two electrical lead wires 47 and 48 are affixed to the spaced connector members 44 and 45 of the separable section 42 of the second connector portion 26. The connections between the connector members 44 and 45 and the lead wires 47 and 48 respectively are at points remote from the surface of the separable section 42 adjoining the second base section 37.

Another electrical lead wire 49 has one end affixed to the secondary connector member 40 of the second base section 37. This connector member 40 is spaced from the separable section 42. The connection of lead wire 49 with the connector member 40 is at a point remote from the major surface 41 of the second base section 37.

The connector members 28–30 in first connector portion 25, the connector members 38–40 of the second connector portion 26 and the connector members 44 and 45 of the separable section 42 may be of any of a variety of different electrical connecting means. Advantageously, the pairs of connector members which interconnect may be combinations of male and female members. For example, the male connector members 28–30 may be located in first connector portion 25 while the connector members 38–40 of the second connector portion 26 may be female members engageable therewith. Preferably, the male connector members may extend outwardly from the major surface of the respective portion of which they are a part.

The first and the second connector portions may be of any suitable configuration. The peripheral configuration of the first and base sections may be of a circular shape, a multisided shape such as a square, hexagon or the like. More advantageously, the base sections may be formed in a generally triangular configuration and preferably a triangular shape in which the points of the base section are in alignment with the points of the equilateral triangle formed by the three connector members. Such a structure greatly facilitates orientation of the connector members 28–30 of the first connector portion 25 with respect to the connector members 38–40 of the second connector portion 26 when assembling the two portions.

The separable section 42 which forms a part of the second connector portion 26 advantageously is disposed flush with the adjoining surfaces of the second base section 37 with which it is combined. Preferably, the separable section 42 is of a generally bar shaped configuration as shown in the drawings, with the bar forming one edge of the triangular base section 26.

As pointed out above, each of the connector portions 25 and 26 includes at least three connector members. While the use of only three connector members in each portion provides for the interconnection of the tail, stop and turn signal lights, it may be desirable under some circumstances to utilize more than the three members. For example, a fourth connector member 52 in portion 25, and 53 in portion 26 may be employed to provide a ground connection for the lighting circuits. Advantageously, the fourth connector members 52 and 53 may be disposed centrally of the three triangularly oriented connector members in the particular connector portion. Additional connector members may be used to energize other lighting or operational electrical circuits on the trailer such as brake actuating circuits, utility circuits for heating or cooling devices and the like.

To facilitate subsequent reconnection of the first connector portion 25 with the second connector portion 26 after proper orientation of the two portions has been established, orientation identifying means may be associated with the two connector portions. Such identifying means may include markings located on each of the portions at points aligned with one another. As shown, marking 54 on an edge of the first connector portion 25 is aligned with marking 55 on a corresponding edge of the second connector portion 26 and with marking 56 on separable section 42 when the portions are mated with each other. Thus, with the portions 25 and 26 separated, an individual can locate the markings in the respective portions and align them so that the first reconnection of the portions will provide the desired combination of the circuitry. If the connector apparatus 11 of the invention is utilized to interconnect one previously wired unit with other units, additional different markings may be employed to provide the same quick identification of the desired orientation.

In the use of the lighting connector apparatus 11 of the present invention as shown in the drawings, the lead wires 33, 34 and 35 are attached to connector members 28–30 of the first connector portion 25. Then, wire 49 is attached to connector member 40 and wires 47 and 48 attached to connector members 44 and 45 of the separable section 42. The separable section 42 is combined with second base section 37.

The lead wires 33–35 are connected to the lighting circuitry of the vehicle 12 and the lead wires 47–49 connected to the lighting circuitry of the trailer 13. The connection of the lead wires to the respective lighting circuits thus is completed on the first connection. To provide the desired circuit connections, it is necessary to establish the required orientation of the respective connector members of the first connector portion 25 with those of the second connector portion 26.

Since there are six possible combinations of the two sets of three wires, the connector positions 25 and 26 are interconnected in each of three possible portions by rotating one connector portion with respect to the other, one position at a time in either a clockwise or counterclockwise direction. If the correct combination is achieved in any of the first three positions, the orientation is marked and no further testing is necessary.

However, if the first three tests do not provide a correct combination, then the position of separable section 42 is reversed in the second base section 37. Thereafter, the first and second connector portions 25 and 26 are again recombined as above for three more tests. Since there are only six possible combinations mathematically, one of the three latter tests will be the correct combination if one of the first three tests has not been successful. When the correct combination is found, the two portions are marked to facilitate future reconnection.

If it is desired to combine either the vehicle or the trailer with a different unit, the above test sequence is repeated with one time connection of the lead wires to the lighting circuit of the particular unit. The connector portions simply are plugged together in each of the first three positions, the separable section 42 reversed if necessary and then the second set of three positions checked.

The lighting connector apparatus of the invention may be fabricated from a variety of materials. The base sections 27 and 37 and separable section 42 may be formed of insulating materials such as a plastic, rubber or the like. The connector members may be formed of a conductive material such as a metal or a metal alloy.

The above description and the accompanying drawings show that the present invention provides a novel lighting connector apparatus which simplifies the interconnection of the lighting circuitry of a trailer with the lighting circuitry of a towing vehicle. The lighting connector apparatus of the invention permits the wiring connections to be completed in one operation without repeated disconnecting and reconnecting to achieve the desired wiring combination.

The lighting connector apparatus of the present invention makes convenient the electrical connection of the lighting circuits of one vehicle with multiple trailers. Also, multiple vehicles can be connected with a single trailer easily. The apparatus can be used by persons of all ages even though they have little or no electrical aptitude or experience.

The connector apparatus is simple in design and can be manufactured from commercially available materials. The apparatus can be fabricated relatively inexpensively using conventional connector manufacturing techniques. The apparatus is durable in construction and has a long useful life without maintenance.

It will be apparent that various modifications can be made in the particular connector apparatus described in detail above and shown in the drawings within the scope of the invention. For example, the size, configuration and arrangement of components can be changed to meet specific requirements. The number and orientation of the connector members in the respective portions may be different provided the functioning and operation of the apparatus are not deleterously affected. Also, the connector apparatus can serve as an adapter between other types of lighting connecting devices to provide simple and convenient connection thereof. Therefore, the scope of the invention is to be limited only by the following claims.

What is claimed is:

1. Vehicle/trailer lighting connector apparatus including a first connector portion and a second connector portion engageable with said first connector portion; said first connector portion including a first base section, at least three primary connector members associated with a major face of said first base section, electrical lead wires with an end of one of said wires affixed to each of said primary connector members at a point thereon remote from said major face of said first base section, three of said primary connector members being arranged in an equilateral triangular configuration; said second connector portion including a second base section, at least three secondary connector members associated with a major face of said second base section, three of said secondary connector members being disposed in a triangular configuration with the arrangement of said secondary connector members corresponding to the arrangement of said primary connector members of said first connector portion, each of said primary connector members of said first connector portion being engageable with one of said secondary connector members of said second connector portion, said second connector portion including a section separable from said second base section, said separable section including two spaced connector members engageable with two of said secondary connector members of said second connector portion at points remote from said major face of said second base section, two electrical lead wires with an end of one of said wires affixed to each of said spaced connector members of said separable section of said second connector portion at a point thereon remote from the surface of said separable section adjoining said second base section of said second connector portion, an electrical lead wire having one end affixed to said secondary connector member of said second base section spaced from said separable section at a point on said connector member remote from said major face of said second base section; whereby connecting said separable section with said second base section in one of two reversible positions and rotating the connection of said first connector portion with respect to said second connector portion provides coordinated operation of vehicle lighting with lighting of a trailer attached to said vehicle.

2. Vehicle/trailer lighting connector apparatus according to claim 1 wherein one of said first and second connector portions includes male connector members and the other of said connector portions includes female connector members engageable with said male connector members.

3. Vehicle/trailer lighting connector apparatus according to claim 2 wherein said male connector members extend outwardly from said major face of said connector portion.

4. Vehicle/trailer lighting connector apparatus according to claim 1 including a fourth connector member in each of said first and second connector portions.

5. Vehicle/trailer lighting connector apparatus according to claim 4 wherein said fourth connector members in said first and second connector portions are disposed centrally of said three connector members in each portion.

6. Vehicle/trailer lighting connector apparatus according to claim 1 wherein said first and second connector portions have substantially the same configuration.

7. Vehicle/trailer lighting connector apparatus according to claim 1 wherein said first and second connector portions have a generally triangular configuration.

8. Vehicle/trailer lighting connector apparatus according to claim 1 wherein said separable section of said second connector portion is capable of being disposed flush with the adjoining surfaces of said second base section of said second connector portion.

9. Vehicle/trailer lighting connector apparatus according to claim 1 wherein said separable section has a generally bar shaped configuration.

10. Vehicle/trailer lighting connector apparatus according to claim 1 including orientation identifying means associated with said first and second connector portions.

* * * * *